United States Patent [19]

Coote

[11] Patent Number: 4,775,061

[45] Date of Patent: Oct. 4, 1988

[54] SAFETY BOTTLE CAP

[76] Inventor: David J. Coote, 50 Lorne St., St. Catharines, Ontario, Canada, L2P 3C4

[21] Appl. No.: 124,290

[22] Filed: Nov. 23, 1987

[51] Int. Cl.[4] ..... B65D 55/02

[52] U.S. Cl. ..... 215/215

[58] Field of Search ..... 215/207, 215, 296, 219; 220/284

[56] References Cited

U.S. PATENT DOCUMENTS 3,468,444 9/1969 Martin, Jr. ..... 215/219

3,501,041 3/1970 Schaefer ..... 215/215

*Primary Examiner*—George T. Hall

*Attorney, Agent, or Firm*—McConnell and Fox

[57] ABSTRACT

A screw top closure is provided with a freely rotating ring surrounding its periphery thus preventing the user from rotating the closure by gripping the periphery. The ring is captivated on the closure and cannot easily be removed. The closure is provided with a key way on its upper surface which the user can engage with a key which is accessible only to authorized users.

8 Claims, 2 Drawing Sheets

SAFETY BOTTLE CAP

FIELD OF THE INVENTION

This invention relates to screw top closures for containers and particularly to screw top closures of the safety type which prevent unauthorized removal of the closure.

DESCRIPTION OF THE PRIOR ART

It has been recognized many dangerous materials in containers with screw tops must not be accessible to unauthorized persons, in particular, to children and others who are not appreciative of the dangerous material contained. Various solutions have been provided in the past to render such screw top closures difficult to remove by providing clutch actions or actions which require the user to depress the closure in a particular manner before it can be removed. It is surprising, however, how quickly children learn to defeat such safety devices and are able to remove the closure and get at the contents. It would appear desirable to have a screw top closure which, while simple and economic to manufacture, nevertheless prevents access without a suitable tool or key.

SUMMARY OF THE INVENTION

In accordance with the present invention, the screw top closure is surrounded by a freely rotating ring which prevents the closure from being rotated manually by gripping its periphery. The upper surface of the closure is provided with an opening which will receive a suitable tool or key and thus permit rotation of the closure. Pulling or pushing on the outer ring and rotating at the same time will not rotate the inner portion of the closure. The only accessible portion of the closure which can cause rotation is the upper surface which is essentially flat so as to provide very little purchase to any unauthorized person attempting to rotate the closure.

A clearer understanding of my invention may be had from consideration of the following description and drawings.

DESCRIPTION OF THE PREFERRED EMBODIMENT

Figure 1:
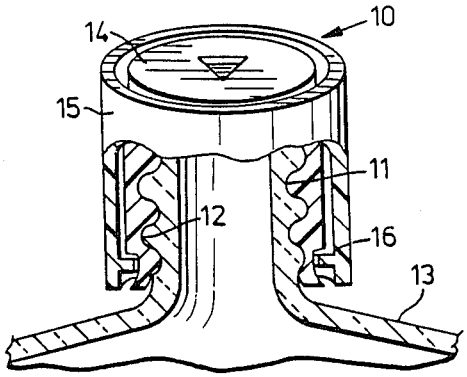
FIG. 1 is the upper portion of a container with a cap in place, partially in section, in accordance with my invention.

As shown in FIG. 1, the cap 10 has an internal thread 11 which engages the external threads 12 of a container 13, only the neck and shoulder of which has been illustrated. The inner portion of cap 10 designated 14 which bears threads 11 is surrounded by a ring 15 which freely rotates on the inner portion 14 but is prevented from escaping by its engagement with the inner portion 14.

Figure 2:
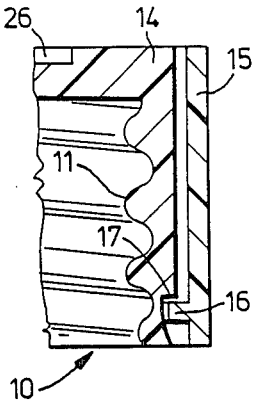
FIG. 2 is a partial section of the cap.

As shown in FIG. 2, the ring 15 has an inwardly directed ridge 16, the inner diameter of which is less than the outer diameter of most of portion 14. The diameter of portion 14 is however reduced at its lower edge forming a step 17. The ridge 16 engages step 17 and prevents the ring 15 from being pulled upwards past the inner portion 14. The lower edge of portion 14 spreads outwards capturing ridge 16 and preventing ring 15 from being removed.

In manufacture, the parts 14 and 15 will be produced with the lower portion of 14 extending straight downwards and permitting ring 15 to be assembled onto part 14. The lower edge of part 14 may then be swaged or otherwise enlarged or distorted to prevent ridge 16 from passing thus capturing ring 15 on part 14 but at the same time permitting ring 15 to freely rotate. If the parts of the cap are made from thermoplastic material it will be convenient to heat and swage the lower edge of part 14 outwards until it is the same diameter as the upper portion of part 14.

Figure 3:
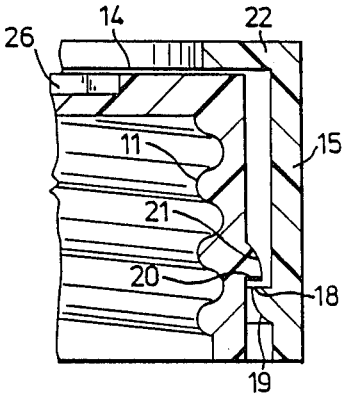
FIGS. 3 and 4 are partial sections of alternative constructions of a cap in accordance with my invention.
Figure 4:
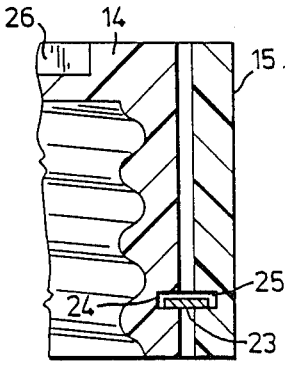

Alternative structures for capturing ring 15 are shown in FIGS. 3 and 4. In FIG. 3, for example, the ring 15 has a ridge which extends inwardly forming a step 18 whose lower surface 19 is smoothly contoured. A similar step is formed on the outside of part 14 forming a step 20 and a smoothly contoured upper surface 21. The upper end of ring 15 has an inwardly projecting ridge 22 which has an inner diameter less than the outer diameter of part 14. In assembly, the ring 15, which is of a sufficiently resilient material, is pushed down over part 14 until ridge 18 passes over ridge 20. Because of the contour of the ridges, they will pass over each other in the direction of assembly but will not pass over each other when any attempt is made to withdraw them.

The upper ridge 22 engages the upper surface of part 14 and prevents ring 15 from passing down any further over part 14.

FIG. 4 illustrates a further alternative construction in which the inner portion 14 and the ring 15 have matching slots cut on their outer and inner surfaces respectively. A resilient ring 23 having a slot sufficiently wide in its periphery to permit it to be snapped over part 14 and into the slot 24 of part 14. It is then compressed so that it may pass through the inner diameter of ring 15. When the slot 25 in ring 15 is aligned with slot 24 the resilient ring 23 springs out and engages slot 25 in a manner well known to those skilled in the art. Ring 15 is then captured on part 14 and cannot be removed without compressing ring 23 which, because of its location and construction, is virtually impossible.

Figure 5A:
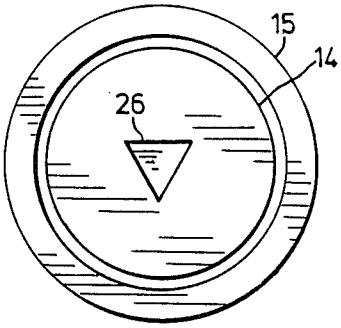
FIG. 5A is a top view of a cap in accordance with my invention having a particular key way.
Figure 6A:
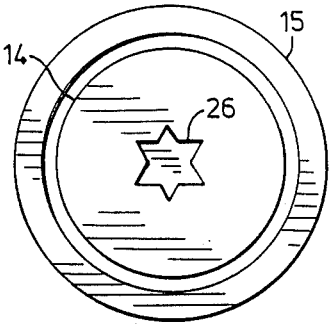
FIG. 6A is a cap showing an alternative form of key way.
Figure 5B:
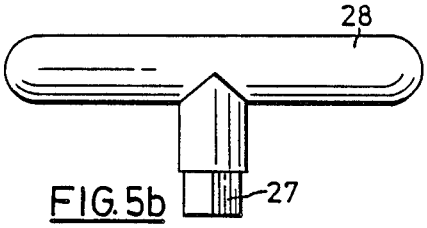
FIGS. 5B and 5C are elevational and plan views of a key suitable for removing the cap of FIG. 5A.
Figure 5C:
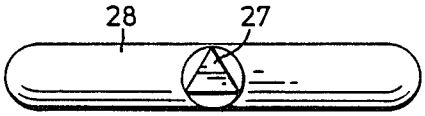

As will be seen, to this point, all the alternative forms of construction provide an inner cap 14 which is threaded onto the container and an outer ring 15 which surrounds the cap around its periphery in such a manner as to prevent the periphery of part 14 being gripped and rotated. The only manner of rotating part 14 is by engagement with its upper surface, which is exposed. The upper surface, however, is smooth except for a suitable key way. Typical suitable key ways are illustrated in FIGS. 5A and 6A. While shown as a triangle and an irregular star-shaped pattern, it is evident that any number of irregular key ways could be used in any form other than a plain circle. The key ways, such as key way 26 in FIG. 5A, extend a small way down into the top surface of part 14 as shown in FIGS. 2, 3 and 4. A key, such as the key illustrated in FIGS. 5B and 5C, has a corresponding portion 27 which is shaped to fit the key way. The upper portion of the key constitutes a handle 28 which may be conveniently gripped by the user.

Figure 6B:
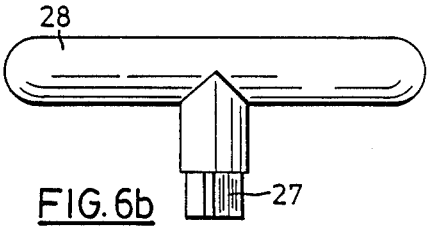
FIGS. 6B and 6C are elevational and plan views of keys suitable for removing the cap of FIG. 6A.
Figure 6C:
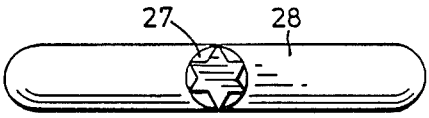

FIGS. 6A, 6B and 6C illustrate an alternative key and key way and the same designations have been used for corresponding components since the functions are identical and the keys differ only in cross-section.

Figure 7:
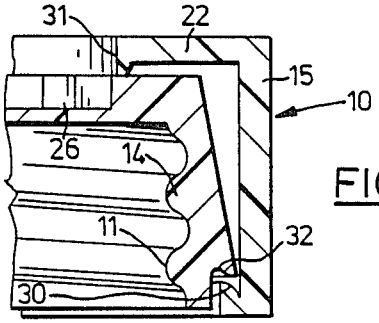
FIG. 7 is a further alternative structure shown as a partial section.

FIG. 7 illustrates a construction which is similar to the structure of FIG. 3 but incorporates further improvements. Here the cap 10 includes a ring 15 having a ridge at its lower edge and this ridge has an upper surface 30 which joins the inner surface of ring 15 at an angle of less than 90° degrees. Part 14 is tapered from its upper end, where it is about the same direction as the ridge at the lower edge of ring 15 to near its lower end where it is about the same diameter as the internal diameter of the main portion of ring 15. As will be seen the diameter of part 14 is reduced at its lower end to form a step with a surface 32 which forms an angle of less than ninety degrees with the main body of part 14.

The upper end of ring 15 ends in an annular inwardly extending flange portion 22 which engages the upper surface of part 14 at its inner edge which includes a ridge or bead 31 which bears on the upper surface of part 14.

In manufacture the two parts 14 and 15 are moulded from a suitably resilient material to permit ring 15 to be pressed down over part 14, expanded by the tapered form and snapping into place with surface 30 below surface 32. The annular portion 22 prevents the ring 15 from slipping down any further and the angular form of surfaces 30 and 32 prevent the ring 15 from being withdrawn. The annular portion inhibits the user from crushing the ring 15 and the reduced diameter of part 14 at its upper end and makes it very difficult for a user to create a frictional engagement between the inner surface of ring 15 and the outer surface of part 14. The bead 31 also minimizes the frictional bearing surface between ring 15 and part 14 thus making it difficult for the user to rotate part 14 by forcing ring 15 down on the upper surface of part 14.

It will be seen that by suitable selection of keys and key ways, the safety cap may be arranged to be operable only by selected persons by providing only certain persons with certain keys which will operate only certain caps. Also, both the cap and the key can be colour coded in such a manner that the user may easily identify the proper key for the purpose. For example, in molding the plastic, suitable colour may be introduced into the plastic thus making the cap 5A red and the corresponding key, as in 5B and 5C, also red. These additional codes and controls help to ensure that the user will not inadvertently open the wrong container.

While three possible means have been illustrated for captivating ring 15 on the inner portion 14, it will be evident that various alternative structures could be provided. It will also be understood that while the captivating means has been shown at the lower part of the inner portion 14 and the outer portion 15, it will be understood that there may be some advantage to putting the capture mechanism at the top thus preventing tampering by forcing material between the inner portion and the outer ring 15 in the space between them thus jamming the mechanism.

Structures such as those shown in FIG. 3 have particular advantage in that because of ridge 22 the space between the inner portion 14 and the ring 15 is not easily accessible. Similar provisions could be made on the structure shown in FIG. 4. It will also be understood that while the keys and key ways are substantially prismatic as illustrated, it is not necessary that they be prismatic, they could be any irregular shape which will permit the key to engage the inner portion 14 and rotate it. It will also be understood that a similar key must be utilized in initially closing the container and that, in use, the key must be rotated with sufficient force to ensure that the inner portion is firmly engaged with the container so that if the outer ring is rotated and there is some small degree of friction between the two components, the inner ring will not be rotated.

Selection of suitable materials for the key and the inner portion will, of course, depend upon the amount of force applied and the shape of the key and key way. It will be understood that some force should be applied in initially installing the cap or re-installing the cap and the key and key way must be sufficiently strong to permit such force. It will also be seen that the depth of the key way is limited by the thickness of the upper portion of part 14 and some dexterity may be required to ensure that the key remains in place during operation. This is an added advantage ensuring that unauthorized opening is virtually impossible. Forcing other materials such as spatulas and rubber materials into the key way should be difficult and should be insufficient to provide necessary torque to rotate part 14.

While it has been assumed that the various components are molded from plastic, it will be evident that under some circumstances the various portions could be formed from other materials which have adequate properties to perform the functions. For example, the outer ring 15 could be made from metal, except in the case of the form shown in FIG. 3 where it would not likely be sufficiently flexible to permit installation unless the upper ridge 22 was formed after installation, such as by spinning the top edge down after assembly to form the ridge 22. Part 14 might also be made of metal if desirable. It will be understood that in such case the key way would probably be formed by embossing the top of the cap to receive the key rather than molding the key way in place as in the case of plastic.

I claim:

1. A screw top closure comprising an inner threaded portion for engaging a corresponding threaded portion of a container, an outer ring completely surrounding the periphery of said inner portion and captivated thereon but completely free to rotate with respect to said inner portion and a key way only in the upper surface of said inner portion for receiving a key to permit rotation of said inner portion by means of a key but leaving said outer ring free to rotate.

2. A screw top closure as claimed in claim 1, wherein said ring includes an annular extension completely covering a peripheral portion of the upper surface of said inner portion.

3. A screw top closure as claimed in claim 1, wherein said ring is captivated on said inner portion by overlapping engaging steps on the inner portion of said ring and the outer portion of said inner threaded portion.

4. A screw top closure as claimed in claim 1, wherein said key way comprises a noncircular indentation in the upper surface of said inner portion essentially concentric with said inner portion for receiving a key of a cross-section corresponding to the cross-section of said indentation.

5. A screw top closure as claimed in claim 1, wherein said inner portion is tapered on its outer surface from a lesser diameter at its upper end to a greater diameter adjacent its lower end.

6. A screw top closure for use with a bottle having a threaded neck, comprising;

(a) an inner cap portion having a closed upper end and a lower end, open and internally threaded, for engaging and enclosing said threaded neck;

(b) an outer ring portion completely surounding and enclosing the periphery of said cap portion;

said cap portion being tapered from a lesser outer diameter at its upper end to a greater outer diameter at its lower end;

said ring portion having an internal diameter equal to said greater outer diameter of said cap portion except at its ends where flanges project inwardly to a diameter less than said greater outer diameter;

(c) a key way, only in the surface of the upper end of said cap member, adapted to receive a key of non-circular cross-section substantially concentrically with said cap member, whereby said cap member, only, can be rotated by means of said key.

7. A screw top closure as claimed in claim 6 wherein the flange on the end of said ring portion adjacent the upper end of said cap portion protrudes inwardly to a diameter less than said lesser diameter of said cap portion, whereby an annular portion of said upper end of said cap portion is covered by said flange.

8. A screw top closure as claimed in claim 7 wherein said flange adjacent the upper end of said cap portion includes a a bead at its inner edge which projects downwardly onto the surface of said cap portion.

* * * * *